United States Patent [19]

Christ

[11] 4,373,871

[45] Feb. 15, 1983

[54] COMPACT POWER STEERING PUMP

[75] Inventor: John H. Christ, Saginaw, Mich.

[73] Assignee: General Motors Corporation, Detroit, Mich.

[21] Appl. No.: 260,015

[22] Filed: May 4, 1981

[51] Int. Cl.[3] ..... F04B 49/08; F01C 19/08

[52] U.S. Cl. ..... 417/310; 418/132

[58] Field of Search ..... 417/310, 300; 418/131, 418/132

[56] References Cited

U.S. PATENT DOCUMENTS

| | | | |
|---|---|---|---|
| 3,439,623 | 4/1969 | Dietrich | 417/310 |
| 3,495,539 | 2/1970 | Tomite et al. | 417/310 |
| 3,614,266 | 10/1971 | Ciampa et al. | 417/310 X |
| 3,822,965 | 7/1974 | Drutchas et al. | 417/310 X |
| 4,199,304 | 4/1980 | Strikis et al. | 417/310 |
| 4,298,316 | 11/1981 | Strikis | 417/310 |
| 4,347,047 | 8/1982 | Shiezawa et al. | 417/310 |
| 4,347,048 | 8/1982 | Kawabata | 417/310 |

*Primary Examiner*—Richard E. Gluck

*Attorney, Agent, or Firm*—Donald F. Scherer

[57] ABSTRACT

A vane type compact pump for use in a power steering system having a remote reservoir includes a substantially cylindrical housing with a central cylindrical cavity. The cavity has a large opening at one end of the housing and a shaft opening at the other end. A pressure plate, cam, rotor and vane assembly and a thrust plate are axially aligned and positioned in the cavity with the thrust plate being adjacent to and closing the large open end of the cavity. A locking ring engages the housing and limits the axial movement of the thrust plate toward the large open end. A drive shaft is rotatably supported in a bearing in the housing and in a bearing in the thrust plate. The drive shaft is drivingly connected with the rotor intermediate the bearing supports. The fluid discharge from the cam rotor and vane assembly passes through the pressure plate to a space intermediate the pressure plate and housing and then through a flow controlling system which permits a predetermined volume of hydraulic fluid to be delivered to the power steering system. The remaining fluid is redirected to the cylindrical cavity. On its return to the cylindrical cavity, the redirected fluid passes through a portion of an inlet port from which make-up oil is aspirated from the reservoir and a supercharge pressure is established in the cylindrical cavity.

2 Claims, 4 Drawing Figures

COMPACT POWER STEERING PUMP

This invention relates to vane type pumps and more particularly to compact type vane type pumps utilized in power steering systems.

As automotive vehicles become smaller and the number of front wheel drive type vehicles increases, the available space under the hood becomes minimal. Therefore, accessory components, such as power steering pumps, electrical alternators and air conditioning compressors, must be made more compact and more versatile in their mounting arrangements with the engine. As the power steering pump becomes more compact, the drive shaft bearing structure must be shortened. Thus, the cantilever loading which is utilized with present power steering pumps induces high bearing stresses.

The present invention provides a compact pump which can be utilized with a remote reservoir and improved distribution of drive shaft bearing loads. The pump structure of the present invention has a thrust plate disposed adjacent the open end of a cylindrical housing such that the present immediately adjacent atmosphere is at the supercharge level and not at the high system pressure. Thus, the deflection of the thrust plate is minimum so that a bearing support structure can be provided in the thrust plate. A bearing support structure is also provided in the pump housing such that the pump rotor, which is drivingly connected at the shaft, is supported intermediate the two bearing support positions. The pressure plate of this pump structure is disposed adjacent the shaft end of the housing such that fluid delivered by the pump is directed to a pressure space between the housing and pressure plate. From this pressure space, the high pressure fluid is directed to a flow control valve which functions in a conventional manner to distribute the fluid flow. The flow returning to the pump passes through the inlet port and provides supercharging of the interior of the housing through the well-known method of aspiration.

It is therefore an object of this invention to provide an improved compact power steering pump using a remote reservoir wherein the drive shaft member is rotatably supported in the pump housing and in the pump thrust plate while being drivingly connected to a pump rotor disposed intermediate the rotary supports.

It is another object of this invention to provide an improved compact power steering pump utilized with a remote reservoir wherein the pump drive shaft is rotatably supported adjacent one end in the pump housing and at the other end in a thrust plate which provides the end cover for the pump; and wherein the pump discharge is from a space intermediate the pump pressure plate and the pump housing at the shaft end of the pump, which space is in fluid communication with a flow control valve having the longitudinal axis thereof disposed normal to the rotary axis of the drive shaft.

These and other objects and advantages of the present invention will be more apparent from the following description and drawings in which.

Figure 1:
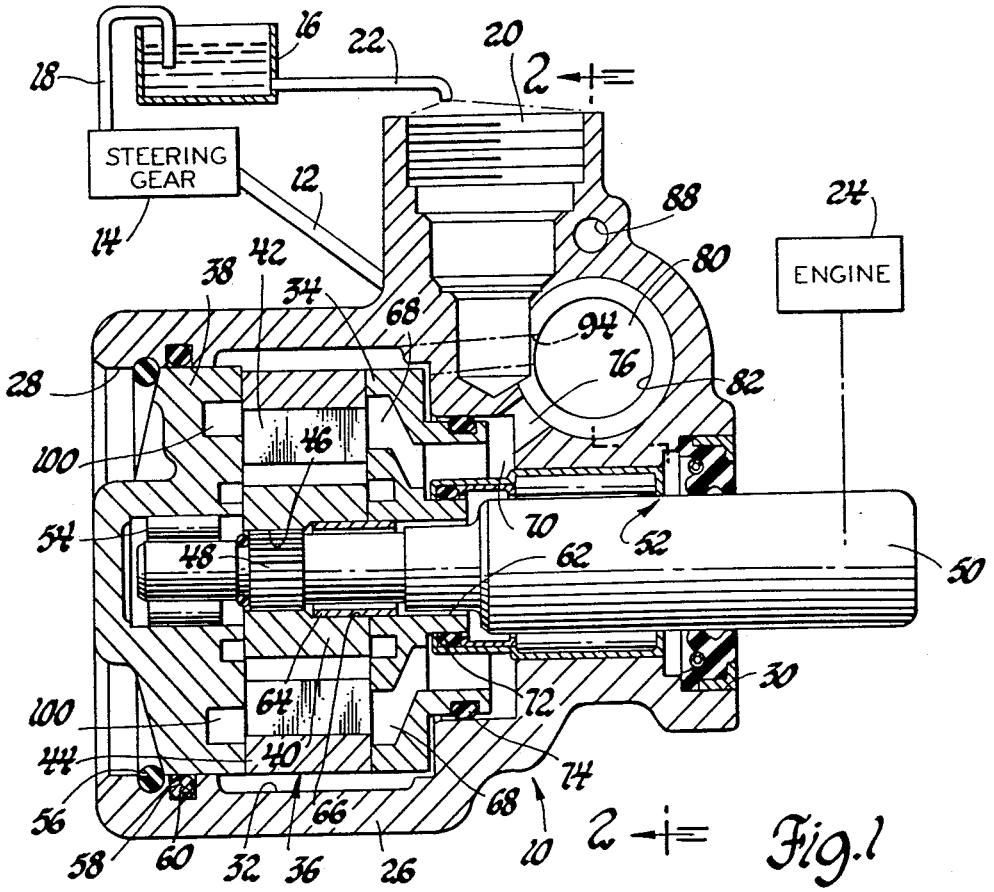
FIG. 1 is a cross-sectional elevational view of a power steering pump incorporating the present invention and includes a diagrammatic representation of associated components.
Figure 2:
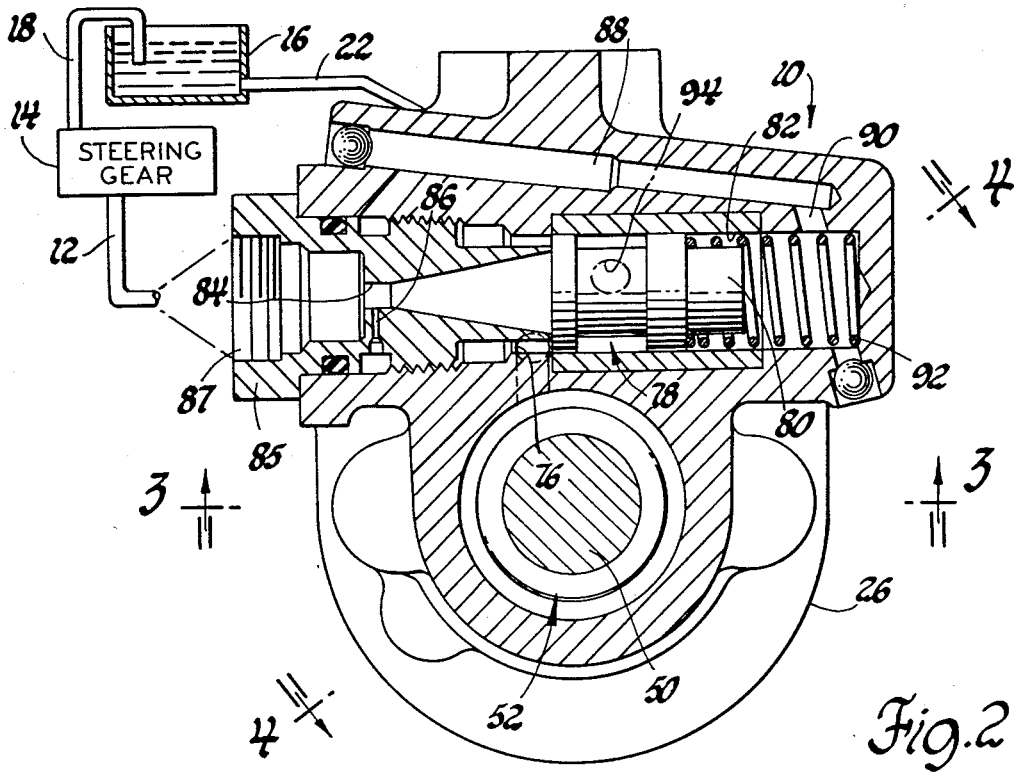
FIG. 2 is a cross-sectional view taken along line 2—2 of FIG. 1.

Referring to the drawings, wherein like characters represent the same or corresponding parts throughout the several views, there is seen in FIG. 1 a power steering pump, generally designated 10, which delivers fluid under pressure through a passage 12 to a conventional power steering gear 14. Fluid is returned to a remote reservoir 16 through a passage 18. Fluid in the reservoir 16 is communicated to an inlet port 20 of the pump 10 through a passage 22. The power steering pump 10 is driven preferably through a belt drive by an internal combustion engine 24.

The power steering pump 10 has a substantially cylindrical housing 26 having a large open end 28 and a shaft opening 30. A central cylindrical cavity 32 is adjacent the open end 28. The cylindrical cavity 32 houses a pressure plate 34, a vane pump assembly, generally designated 36, and a thrust plate 38. The vane pump assembly 36 includes a rotor 40, a plurality of vanes 42 and a cam ring 44. The construction of the vane pump assembly 36 is well-known and a more complete description can be found in U.S. Pat. No. 3,207,077 issued to Zeigler et al. on Sept. 21, 1965, or in U.S. Pat. No. 3,253,548, issued to Zeigler et al. on May 31, 1966.

The rotor 40 has a central spline portion 46 which is drivingly connected to a spline 48 formed on a drive shaft 50. The drive shaft 50 is adapted to be drivingly connected to the engine 24 and is rotatably supported in a bearing and seal assembly 52 secured in the housing 26 and a bearing assembly 54 disposed in the thrust plate 38. The thrust plate 38 is located in the cavity 32 by a locking ring 56 which limits the leftward movement of thrust plate 38 as viewed in FIGS. 1, 3 and 4. The outer surface of thrust plate 38 is cylindrical and engages a seal ring 58 which is disposed in a groove 60 formed in housing 26.

The pressure plate 34 is disposed in the cavity 32 and has a central aperture 62 through which drive shaft 50 extends. The central aperture 62 is aligned on a bushing 64 which is also aligned in a bore 66 formed on the rotor 40.

As seen in FIG. 1, the pressure plate has a pair of outlet passages 68 which communicate fluid from the assembly 36 to a space 70 defined by the right face of pressure plate 34, the end surface of cavity 32 and the outer surface of the bearing and seal assembly 52. The space 70 is sealed from the remainder of cavity 32 by a seal 72, which is a component of assembly 52, and by a seal 74, which is disposed between the pressure plate 34 and the outer cylindrical surface of cavity 32. The fluid in space 70 is communicated through a passage 76 to a conventional flow control valve assembly 78 disposed in the housing 26. The flow control valve 78 is similar in construction to the flow control valve mechanism described in the above-mentioned U.S. patents and includes a valve spool 80 which is slidably disposed in a valve bore 82. The axis of valve spool 80 is perpendicular to and offset from the rotary axis of the drive shaft 50. Fluid under pressure delivered to the flow control valve 78 passes through a restriction 84 which is formed in a fitting 85 which has incorporated therein an outlet or discharge port 87. The discharge port 87 is connected to passage 12.

The fluid pressure in passage 76 acts directly on the left end of valve spool 80. The pressure at the throat of restriction 84 is transmitted through passages 86, 88 and 90 to the right end of valve spool 80. As is well-known, when the pressure drop through restriction 84 reaches a predetermined value, indicating that the desired flow rate is established, the valve spool 80 will move rightward against a spring 92 thereby permitting excess fluid to bypass the steering gear 14 by flowing through a return or bypass passage 94. The return passage 94, as seen in FIG. 1, is in direct fluid communication with the interior of cavity 32.

While flowing from the flow control valve 78 to the cavity 32, the fluid in passage 94 traverses a portion of inlet port 20. Because of the high velocity of fluid in passage 94, the phenomena known as aspiration occurs resulting in a supercharge pressure within the cavity 32. This supercharge pressure is useful in preventing cavitation at the inlet ports of assembly 36.

Figure 3:
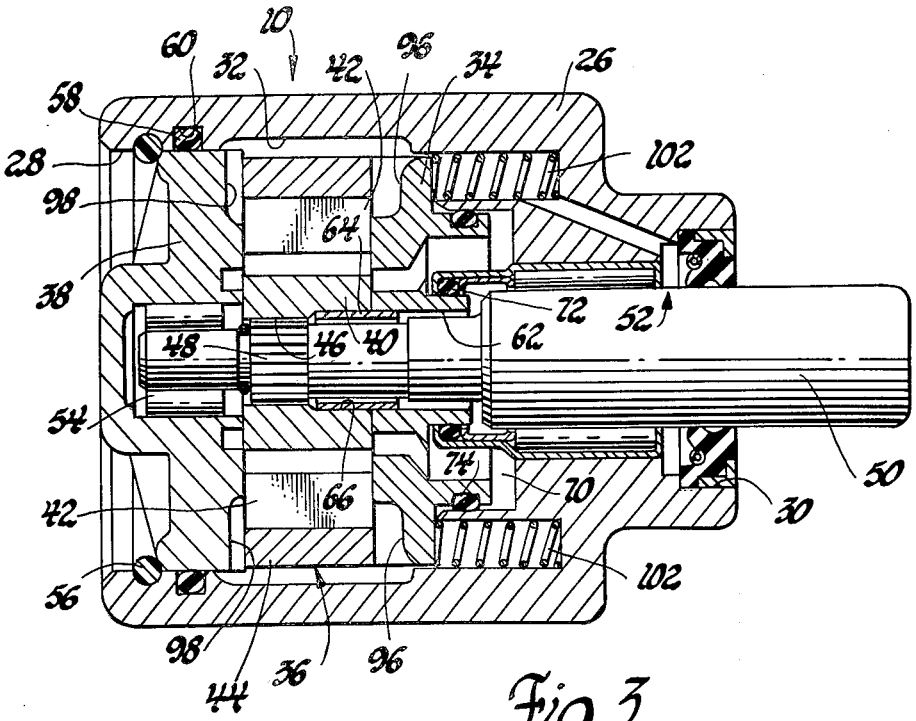
FIG. 3 is a cross-sectional view taken along line 3—3 of FIG. 2.

As seen in FIG. 3, the pressure plate 34 has a pair of recesses 96 formed therein which permit fluid communication between cavity 32 and the pump assembly 36. The thrust plate 38 also has a pair of recesses 98 formed therein which permit fluid communication between the cavity 32 and the pump assembly 36. As is well-known, these recesses 96 and 98 provide the inlet ports for pump assembly 36 while the passages 68 and a plurality of blind recesses 100 form the discharge ports for assembly 36.

As seen in FIG. 3, the pressure plate 34 is urged leftward by a plurality of springs 102 such that the pressure plate 34, cam ring 44 and thrust plate 38 are urged to the left to maintain the thrust plate 38 in abutment with the locking ring 56. The springs 102 assure that the pressure plate 34, cam ring 44 and thrust plate 38 will be maintained in abutment so that fluid pressures does not leak from the interior of assembly 36 to cavity 32 when the pump is initially started or when low pressure operation is occurring. At elevated pump pressures, the fluid in space 70 creates a pressure force acting on the right end face of pressure plate 34 which is added to the force in springs 102 to ensure the sealing integrity of the thrust plate 38, cam ring 44 and pressure plate 34.

Figure 4:
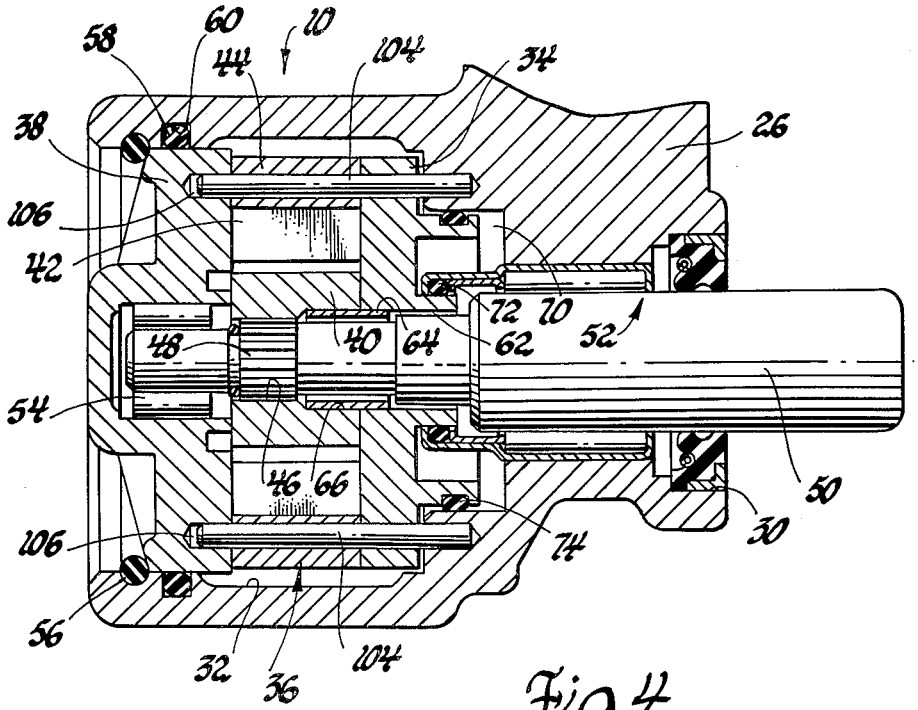
FIG. 4 is a cross-sectional view taken along line 4—4 of FIG. 2.

As is well-known, the thrust plate 38, cam ring 44 and pressure plate 34 must be maintained in axial alignment. These members must also be secured against relative rotation amongst themselves and with the housing 26. The axial alignment and nonrotatability of these parts is assured through the use of a pair of dowel pins 104 as seen in FIG. 4. The dowel pins 104 are secured in the housing 26, pass close fit openings in the pressure plate 34 and cam ring 44 and are aligned in blind apertures 106 formed in the thrust plate 38.

As seen in FIGS. 1, 3 and 4, the housing 26 has a cylindrical outer surface at the left end thereof. This cylindrical surface can be utilized as a mounting surface when the power steering pump 10 is assembled to the engine 24. The outer surface of housing 26 can be threaded such that the power steering pump 10 can be threaded to a bracket or to a complementary threaded aperture in the engine block directly. In the alternative, the outer cylindrical surface of housing 26 can be clamped to a corresponding semicylindrical surface formed in the engine or in a bracket secured to the engine. By utilizing the cylindrical surface as a mounting structure, the angular orientation of inlet port 20 and the discharge port 87 of the power steering pump 10 connected to passage is extremely adjustable. Thus, the power steering pump can be adapted to a wide variety of engine applications wherein the main fluid reservoir is mounted remotely from the pump. By providing a rotary support for the drive shaft 50 in the thrust plate 38, the axial length of the power steering pump 10 is substantially reduced when compared to conventional power steering pumps of either the remote reservoir or integral reservoir variety.

The embodiments of the invention in which an exclusive property or privilege is claimed are defined as follows:

1. A vane type power steering pump comprising a substantially cylindrical housing having a shaft opening at one end and a larger opening at the other end; a shaft extending through said shaft opening and being rotatably supported adjacent one end in said housing; a pressure plate sealingly engaging said housing and being disposed circumjacent said shaft; a vane pump assembly means disposed in said housing axially adjacent said pressure plate and toward the larger opening and having a rotor being drivingly connected with said shaft; a thrust plate disposed axially adjacent said assembly and rotatably supporting the other end of said shaft, said thrust plate sealingly engaging with said housing and cooperating therewith to close the larger opening; locking ring means engaging said housing and said thrust plate to limit the axial movement of the thrust plate in one direction; fluid inlet means formed in said thrust plate for communicating fluid to said assembly; fluid outlet means in said pressure plate for delivering fluid from said assembly; pressure space means formed by said housing and said pressure plate and having a cross-sectional area less than the total cross-sectional area of said pressure plate, said pressure space means being in communication with said fluid outlet means and cooperating with said pressure plate to create an axial pressure loading on said pressure plate in the direction of said assembly and thrust plate to urge said pressure plate, said assembly and said thrust plate against said locking ring means; fluid flow control valve means disposed in said housing transverse to said shaft and having respective portions in communication with said fluid outlet means and said fluid inlet means; and fluid outlet and fluid inlet port means for respectively directing fluid from said pump and delivering fluid to said pump.

2. A vane type power steering pump comprising a substantially cylindrical housing having a shaft opening at one end and a larger opening at the other end; a shaft extending through said shaft opening and being rotatably supported adjacent one end in said housing; a pressure plate sealingly engaging said housing and being disposed circumjacent said shaft; a vane pump assembly disposed in said housing axially adjacent said pressure plate toward the larger opening and having a rotor drivingly connected with said shaft; a thrust plate disposed axially adjacent said assembly and rotatably supporting the other end of said shaft, said thrust plate sealingly engaging with said housing and cooperating therewith to close the larger opening; locking ring means engaging said housing and said thrust plate to limit the axial movement of the thrust plate in one direction; fluid inlet means formed in said thrust plate for communicating fluid to said assembly; fluid outlet means in said pressure plate for delivering fluid from said assembly; pressure space means formed by said housing and said pressure plate, said pressure space means being in communication with said fluid outlet means and cooperating with said pressure plate to create an axial pressure loading on said pressure plate in the direction of said assembly and thrust plate to urge said pressure plate, said assembly and said thrust plate against said locking ring means.

* * * * *